US010757493B2

(12) United States Patent
Fan et al.

(10) Patent No.: US 10,757,493 B2
(45) Date of Patent: Aug. 25, 2020

(54) SPEAKER MODULE

(71) Applicant: GOERTEK INC., WeiFang, Shandong (CN)

(72) Inventors: Shuangshuang Fan, Shandong (CN); Gang Chen, Shandong (CN)

(73) Assignee: GOERTEK INC., WeiFang, Shandong (CN)

( * ) Notice: Subject to any disclaimer, the term of this patent is extended or adjusted under 35 U.S.C. 154(b) by 0 days.

(21) Appl. No.: 16/310,097

(22) PCT Filed: Dec. 29, 2016

(86) PCT No.: PCT/CN2016/113028
§ 371 (c)(1),
(2) Date: Dec. 14, 2018

(87) PCT Pub. No.: WO2017/215239
PCT Pub. Date: Dec. 21, 2017

(65) Prior Publication Data

US 2019/0335257 A1 Oct. 31, 2019

(30) Foreign Application Priority Data

Jun. 16, 2016 (CN) ..... 2016 1 0436528

(51) Int. Cl.
*H04R 9/06* (2006.01)
*H04R 1/02* (2006.01)
*H04R 1/44* (2006.01)

(52) U.S. Cl.
CPC ..... *H04R 1/023* (2013.01); *H04R 1/026* (2013.01); *H04R 1/44* (2013.01); *H04R 9/06* (2013.01)

(58) Field of Classification Search
CPC ..... H04R 1/02; H04R 1/021; H04R 1/023; H04R 1/025; H04R 1/026; H04R 1/08;
(Continued)

(56) References Cited

U.S. PATENT DOCUMENTS

2011/0038495 A1* 2/2011 Jeong ..... H04R 17/00 381/190
2012/0148074 A1* 6/2012 Bastiaens ..... H04R 19/02 381/191
2017/0289672 A1* 10/2017 Yang ..... H04R 1/22

FOREIGN PATENT DOCUMENTS

CN 103281665 A 9/2013
CN 104202703 B * 12/2014 ..... G04R 1/22
(Continued)

OTHER PUBLICATIONS

Jun Gao, etc., "Recent Development of the Bi-color Injection Molding" Applied Mechanics and Materials, ISSN 1662-7482, vol. 229-231, pp. 2440-2443, Nov. 29, 2012.*
(Continued)

*Primary Examiner* — Leshui Zhang
(74) *Attorney, Agent, or Firm* — Brundidge & Stanger, P.C.

(57) ABSTRACT

The present invention provides a speaker module comprising a module housing, and a speaker unit accommodated in the module housing, and the speaker unit separates a cavity formed by the module housing into a front acoustic cavity and a rear acoustic cavity; sound absorbing particles are filled into the rear acoustic cavity, and the sidewall of the module housing is provided with an isolation mesh cloth for isolating the sound absorbing particles and the speaker unit; the isolating mesh cloth is fixed to a first fixing frame by injection molding, and the first fixing frame is fixed in the corresponding module housing by injection molding. According to the present invention, it can prevent the problems such as leakage, deviation or breakage of the mesh during the process of fixing the isolating mesh cloth.

8 Claims, 3 Drawing Sheets

(58) Field of Classification Search
CPC . H04R 1/086; H04R 1/44; H04R 1/42; H04R 3/04; H04R 3/06; H04R 3/08; H04R 3/02; H04R 9/06; H04R 9/066; H04R 11/02; H04R 11/14
USPC ..... 381/385, 386, 388, 389, 391, 395, 189, 381/411, 413, 414, 124
See application file for complete search history.

(56) References Cited

FOREIGN PATENT DOCUMENTS

| | | | | | |
|---|---|---|---|---|---|
| CN | 204392531 | U | * | 6/2015 | ..... H04R 1/20 |
| CN | 105187960 | | | 12/2015 | |
| CN | 105898659 | A | | 8/2016 | |
| CN | 205754844 | U | | 11/2016 | |
| JP | 9331595 | A | | 12/1997 | |

OTHER PUBLICATIONS

International Search Report from International Application No. PCT/CN2016/113028 dated Feb. 24, 2017.

* cited by examiner

SPEAKER MODULE

TECHNICAL FIELD OF THE INVENTION

The present invention relates to the field of acoustic technology, and more particularly to a speaker module.

BACKGROUND OF THE INVENTION

At present, due to the expansion of consumer electronics market, a large number of mobile phones and notebook computers are widely used, and sounding device also have a wide range of needs as an important acoustic component in consumer electronic products. As consumer electronics products are increasingly required to be lighter in appearance and more excellent in performance, sounding device is increasingly demanding in terms of performance, size, and safety and the like as an important constitution unit of such products.

In the existing sounding device, the mesh cloth for waterproofing or dustproof is generally directly attached to the housing made of the plastic material. Since the mesh cloth is in a non-fixed free state in the mold, it is easily impacted by the plastic to generate deformation, misalignment or wrinkles and the like during the process of fixing to the housing, and the products formed by injection molding may also have problems such as leakage, deviation or breakage of the mesh.

SUMMARY OF THE INVENTION

In view of the above problems, the purpose of the present invention is to provide a speaker module to solve the problems existed in the conventional sounding device, i.e., the positioning between the mesh and the housing is difficult, the mesh cloth is not securely fixed, product tends to become defective product and the qualification rate is low and the like.

The present invention provides a speaker module comprising a module housing, and a speaker unit accommodated in the module housing, and the speaker unit separates a cavity formed by the module housing into a front acoustic cavity and a rear acoustic cavity; sound absorbing particles are filled into the rear acoustic cavity, and the sidewall of the module housing is provided with an isolation mesh cloth for isolating the sound absorbing particles and the speaker unit; the isolating mesh cloth is fixed to a first fixing frame by injection molding, and the first fixing frame is fixed in the corresponding module housing by injection molding.

In addition, preferably, the first fixing frame is provided with positioning ribs for supporting and restraining the isolating mesh cloth therein.

In addition, preferably, the isolating mesh cloth is fixed to the first fixing frame by two-color injection molding, and the isolating mesh cloth which is located outside the first fixing frame is removed by laser or die cutting.

In addition, preferably, the first fixing frame is restrained and fixed in the sidewall of the module housing by two-color injection molding.

In addition, preferably, the front acoustic cavity is in communication with the sounding hole of the speaker module, and the rear acoustic cavity is an enclosed structure; and the module housing is provided with a damping hole which is in communication with the rear acoustic cavity.

In addition, preferably, isolating mesh cloths are respectively disposed at the sounding hole and the damping hole, and the isolating mesh cloths disposed at the sounding hole and the damping hole are injection molded to the corresponding second fixing frame, and the second fixing frame is fixed to the positions of the module housing corresponding to the positions of the sounding hole and the damping hole.

In addition, preferably, the second fixing frame is fixed to the positions of the module housing corresponding to the positions of the sounding hole and the damping hole by injection molding or bonding.

In addition, preferably, the speaker unit comprises a speaker unit shell and a magnetic circuit system accommodated in the speaker unit shell, and the isolating mesh cloth is used for preventing the sound absorbing particles from entering the magnetic circuit system.

In addition, preferably, the speaker unit further comprises a vibration system accommodated in the speaker unit shell, and the vibration system comprises a vibration diaphragm and a voice coil attached to one side of the vibration diaphragm, and the voice coil is suspended in the magnetic circuit system.

In addition, preferably, the speaker unit further comprises an electrical connection board; one end of the electrical connection board is electrically connected to the voice coil, and the other end of the electrical connection board is electrically connected to the external circuit of the speaker module.

With the above-described speaker module according to the present invention, by means of fixing the isolating mesh cloth on the fixing frame, and then fixing the fixing frame which is fixed with the isolating mesh cloth on the module housing, a good positioning between the isolating mesh cloth and the module housing is achieved; furthermore, by means of respectively fixing the isolating mesh cloth and the module housing, the problems such as leakage, deviation or breakage of the mesh can be solved, so that the stability of the product is ensured and the qualification rate of the product is increased.

In order to achieve the above-described and related purposes, one or more aspects of the present invention comprise the features that will be described below in detail and particularly set forth in claims. The following description and the drawings illustrate certain illustrative aspects of the present invention in detail. However, these aspects are merely a part of the various methods which can apply the principles of the present invention. In addition, the present invention is intended to comprise all such aspects and their equivalents.

BRIEF DESCRIPTION OF THE DRAWINGS

The other purposes and results of the present invention will become more clear and easy to be understand through the following descriptions in combination with the accompanying drawings and contents of claims, along with more fully understood of the present invention.

Figure 1:
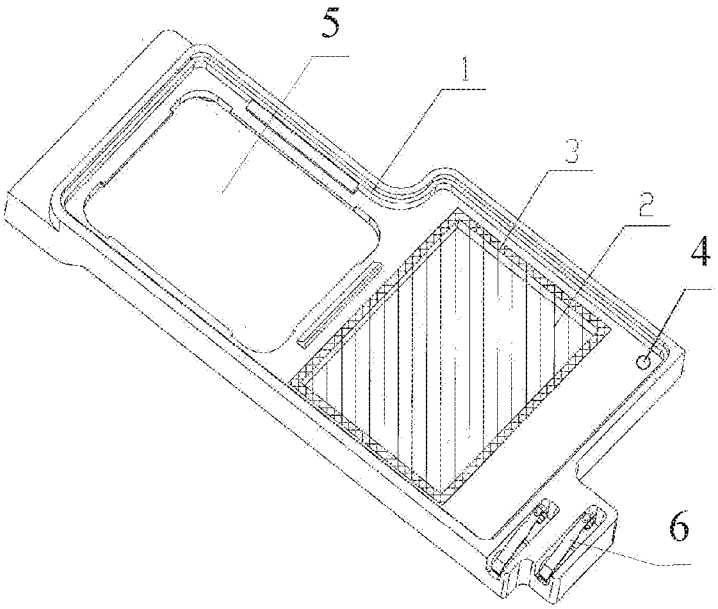
FIG. 1 is a structural schematic diagram of a module housing of a speaker module according to an embodiment of the invention.

Reference numerals comprise: 1, module housing; 2, isolating mesh; 3, first fixing frame.

The same reference numbers indicate similar or corresponding features or functions in all of the drawings.

DETAILED DESCRIPTION OF EMBODIMENTS OF THE INVENTION

In the following description, for the purposes of illustration, in order to provide a thorough understanding of one or more embodiments, numerous specific details are explained. However, obviously, these embodiments also can be implemented without these specific details. In other examples, in order to facilitate describing one or more embodiments, well-known structures and apparatus are illustrated in the form of block diagram.

In order to describe the structure of the speaker module of the embodiment according to the present invention in detail, the embodiments of the present invention will be described in detail below in combination with the accompanying drawings.

Figure 2:
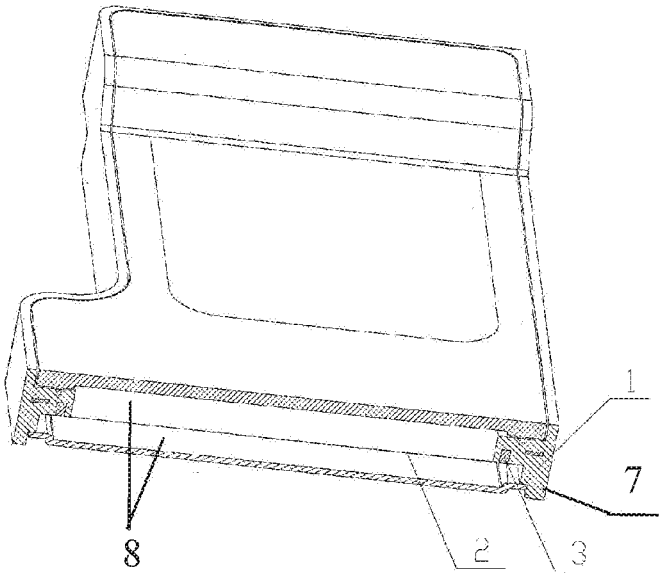
FIG. 2 is a cross-sectional view of a speaker module according to an embodiment of the present invention.

FIG. 1 illustrates the structure of a module housing of a speaker module according to an embodiment of the invention; FIG. 2 illustrates the structure of a cross-section of a speaker module according to an embodiment of the present invention.

As shown in FIG. 1 and FIG. 2 together, the speaker module according to the embodiment of the present invention comprises a module housing 1, and a speaker unit accommodated in a cavity formed by the module housing 1, wherein the speaker unit separates the cavity formed by the module housing 1 into a front acoustic cavity and a rear acoustic cavity, and sound absorbing particles are filled into the rear acoustic cavity, and the sidewall 7 of the module housing 1 is provided with an isolation mesh cloth 2 for isolating the sound absorbing particles and the speaker unit. At the time of fixing and connecting the isolating mesh cloth 2 to the module housing 1, at first, the isolating mesh cloth 2 is fixed in the first fixing frame 3 having a certain shape by injection molding, and then, the first fixing frame 3 provided with the isolating mesh cloth 2 is fixed in the corresponding module housing 1 by injection molding, so as to position the isolating mesh cloth 2 in the module housing 1 accurately.

In particular, the module housing 1 is provided with a slot therein, and the speaker unit is restrained and fixed in the slot corresponding to the structure of the speaker unit, and the cavity formed by the module housing 1 is separated into a front acoustic cavity which is in communication with the sounding hole, and a rear acoustic cavity 8 which is in an enclosed state. Wherein, sound absorbing particles for improving the acoustic performance of the speaker module are filled into the rear acoustic cavity; and in order to prevent the sound absorbing particles from entering the speaker unit to affect the stability of the speaker, the isolating mesh cloth 2 is provided in the rear acoustic cavity of the module housing 1 to isolate the sound absorbing particles and the speaker unit. Sound absorbing particles are provided under the isolating mesh cloth 2. A damping hole 4 is in communication with the rear acoustic cavity 8 of the module housing 1. A mounting hole 5 is provided to mount the speaker unit. An electrical connection board 6 is provided and one end of the electrical connection board is electrically connected to the voice coil, and the other end of the electrical connection board is electrically connected to the external circuit of the speaker module.

Figure 3:
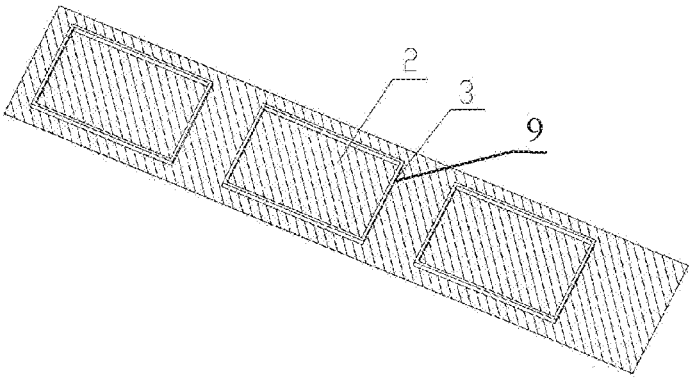
FIG. 3 is a structural schematic diagram of an isolating mesh cloth and a fixing frame according to an embodiment of the invention.
Figure 4:
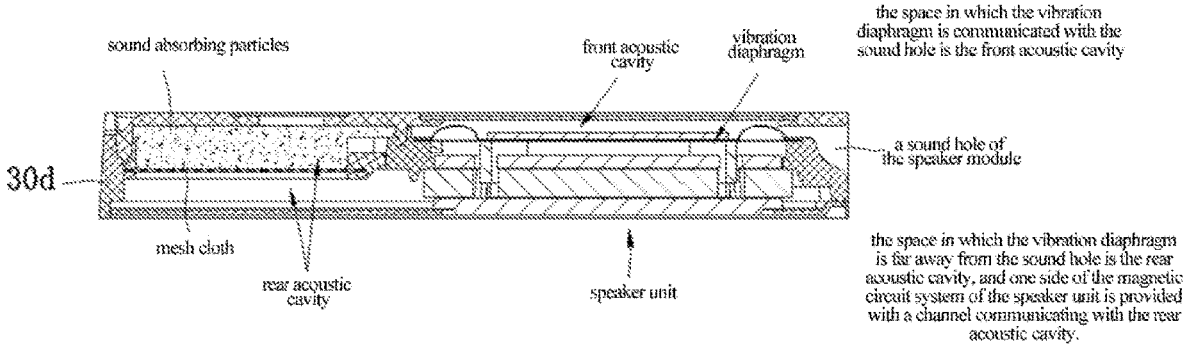
FIG. 4 is a structural schematic diagram of a speaker unit according to an embodiment of the invention.

Wherein, FIG. 3 illustrates the structure of the isolating mesh cloth and the fixing frame according to an embodiment of the invention.

As shown in FIG. 1 to FIG. 3 together, in the speaker module according to the embodiment of the present invention, the first fixing frame 3 may be embodied as plastic frame having various shapes, and the isolating mesh cloth 2 is fixed on the first fixing frame 3 by injection molding in an insert manner. In one embodiment, the isolating mesh cloth 2 located outside the first fixing frame 3 is cut, and only the portion of the isolating mesh cloth 2 located inside the first fixing frame 3 is retained.

The isolating mesh cloth 2 is indirectly fixed in the module housing 1 by means of fixing the first fixing frame 3 provided with the isolating mesh cloth 2 to the module housing 1 by injection molding, wherein the position to be fixed and shape of the isolating mesh cloth can be adjusted by adjusting the first fixing frame.

In a specific embodiment of the invention, the isolating mesh cloth 2 is fixed in the first fixing frame 3 by two-color injection molding, and the isolating mesh cloth 2 located outside the first fixing frame 3 can be removed by laser or die cutting, and only the isolating mesh cloth 2 located within the first fixing frame 3 is retained. Then, the first fixing frame 3 to which the isolating mesh cloth 2 is injection-molded is used as an insert, to be fixed in the module housing 1 by two-color injection molding, and the isolating mesh cloth 2 is flatly fixed in the speaker module by separate injection molding and two-color injection molding, thereby isolating the sound absorbing particles therein and the speaker unit.

In order to prevent the isolating mesh cloth 2 injection-molded in the first fixing frame 3 from being deformed or damaged, in one embodiment of the present invention, a plurality of positioning ribs 9 for supporting and restraining the isolating mesh cloth 2 are provided in the first fixing frame 3. Furthermore, the positioning ribs can also prevent the first fixing frame 3 from being deformed, so as to accurately position the first fixing frame 3 and the module housing 1.

In some embodiments, the isolating mesh cloth 2 can be fixed on the first fixing frame 3 by bonding or pressing.

It should be noted that the fixing manner between the isolating mesh cloth 2 and the first fixing frame 3 according to the embodiment of the present invention can be applied to not only the inside of the speaker module to isolate the internal components of the speaker module, but also the portions such as the sounding hole or the damping hole of the speaker module and the like being in contact with the outside, thereby improving the performance of waterproof and dustproof of the speaker module, and ensuring the performance of the speaker module more excellent.

For example, isolating meshes are respectively disposed at the sounding hole and the damping hole, and the isolating mesh clothes are injection molded on the corresponding second fixing frame. and the second fixing frame which is provided with the isolating mesh clothes by injection molding is fixed at the positions of the module housing corresponding to the positions of the sounding hole and the damping hole. Wherein, the second fixing frame which is provided with the isolating mesh clothes by injection molding can be fixed at the positions of the module housing corresponding to the positions of the sounding hole and the damping hole by various methods such as injection molding or bonding and the like.

Specifically, the damping hole is provided on the portion of the module housing where the rear acoustic cavity is located, to permit the rear acoustic cavity to communicate with the external environment, thereby ensuring the balance of the air pressure between the rear acoustic cavity and the front acoustic cavity, and preventing the difference of air pressure from affecting the vibration of the vibration diaphragm. wherein under the premise that the damping hole acts as a gas leakage, the smaller the diameter of the damping hole is, the better the damping hole. The acoustic resistance of the damping hole can be increased by attaching the isolating mesh cloth or the damping mesh at the damping hole, so as to reduce the effect of the damping hole on the acoustic performance.

Wherein the isolating mesh cloth or the damping mesh of the damping hole may be injection-molded on the second fixing frame corresponding to the shape of the damping hole in advance, and then, the second fixing frame provided with the isolating mesh cloth or the damping mesh by injection molding is injection molded or bonded on the portion of the module housing where the damping hole is located. Furthermore, the isolating mesh cloth located at the sounding hole may also be provided in a similar method, and as for the second fixing frame and the first fixing frame, their structure and manner for fixing with the isolating mesh cloth can be configured in common, which will not be repeated.

In another embodiment of the invention, the speaker unit comprises: a speaker unit shell; and a magnetic circuit system and a vibrating system accommodated in the speaker unit shell, and the isolating mesh cloth 2 is used for preventing sound absorbing particles from entering the magnetic circuit system. Wherein the vibration system comprises a vibration diaphragm fixed to the speaker unit shell and a voice coil fixed to one side of the vibration diaphragm. The magnetic circuit system comprises a magnetic conductive yoke, a magnet fixed at the center of the magnetic conductive yoke, and a washer fixed to the side of the magnet away from the magnetic conductive yoke.

Specifically, in a dual magnetic circuit system, the magnet further comprises a center magnet and a side magnet disposed around the center magnet, and the washer comprises a center washer and a side washer, which correspond to the center magnet and the side magnet respectively. A magnetic gap is formed between the center magnet and the side magnet, and a magnetic gap is formed between the center washer and the side washer, and the voice coil is suspended in the magnetic gap. When the voice coil in the magnetic field has an acoustic current flowing through, the voice coil is subjected to an alternating pushing force to generate an alternating movement, thereby driving the vibration diaphragm to vibrate, and further repeatedly pushing the air to generate a sound.

In addition, the speaker module according to the embodiment of the present invention further comprises an electrical connection board, wherein one end of the electrical connection board is electrically connected to the voice coil, and the other end of the electrical connection board is electrically connected to the external circuit of the speaker module. Wherein the elastic piece of the speaker unit is exposed and fixed to the speaker unit shell, and the elastic piece is electrically connected to both of the lead wire of the voice coil and the electrical connection board. An electrical connection is established between the voice coil and the external circuit when the electrical connection board is electrically connected to the external circuit, thereby achieving an electrical connection between the internal circuit and external circuit of the speaker unit. Wherein the electrical connection board may be an FPCB (Flexible Printed Circuit Board).

It should be noted that, the module housing 1 according to the embodiment of the present invention may comprise a module upper case and a module lower case which are matched and connected. The setting position of the fixing frame (the first fixing frame and/or the second fixing frame) can be adjusted according to the production requirements or the position relationship between the internal components which need to be isolated. The shape and size of the fixing frame can also be adjusted according to the installation position thereof.

It can be seen from the above embodiment that, in the speaker module according to the present invention, the isolating mesh cloth or the damping mesh and the like is fixed in a fixing frame provided in advance by injection molding. By means of fixing the fixing frame to the outer housing of the product by injection molding, the insolating mesh cloth or the damping mesh and the like are firmly combined with the speaker module, thereby effectively preventing the problems such as leakage, deviation or breakage of the mesh. Furthermore, the fixing frame can also be formed into a variety of shapes such as regular shape or irregular shape, and has a wide application range, which can effectively increase isolation properties of the product such as the waterproofing, dustproof and the like, thereby improving the stability and the qualification rate of the product.

The speaker module according to the present invention is described by way of example with reference to the accompanying drawings. However, those skilled in the art can understand that various modifications may be made to the speaker module according to the above-described present invention without departing from the scope of the present invention. Therefore, the protection scope of the present invention should be determined by the contents of the appended claims.

The invention claimed is:

1. A speaker module comprising:

a module housing having side walls and forming a cavity;

a speaker unit accommodated in the module housing, the speaker unit separates the cavity formed by the module housing into a front acoustic cavity and a rear acoustic cavity;

sound absorbing particles that are filled in a portion of the rear acoustic cavity between the side walls of the module housing;

an isolation mesh cloth for isolating the sound absorbing particles from the speaker unit and the isolation mesh cloth is indirectly fixed in the module housing; and a fixing frame, wherein the indirectly fixing the isolation mesh cloth in the module housing is performed by fixing the isolating mesh cloth to the fixing frame by bonding, pressing or injection molding in an insert manner, and further fixing the fixing frame in the module housing by injection molding; and a position used for fixing the fixing frame to the module housing and a shape of the isolating mesh cloth are adjusted by adjusting shapes of the fixing frame.

2. The speaker module according to claim 1, wherein the fixing frame is provided with positioning ribs therein, the positioning ribs are used for supporting and limiting the isolating mesh cloth.

3. The speaker module according to claim 1, wherein the isolating mesh cloth is fixed to the fixing frame by bi-color injection molding, and the isolating mesh cloth which is located outside the fixing frame is removed by laser or die cutting.

4. The speaker module according to claim 1, wherein the fixing frame is limited and fixed in the sidewall of the module housing by bi-color injection molding.

5. The speaker module according to claim 1, wherein the front acoustic cavity is in communication with a sounding hole of the speaker module, and the rear acoustic cavity is an enclosed structure, and the module housing is provided with a damping hole which is in communication with the rear acoustic cavity.

6. The speaker module according to claim 1, wherein the speaker unit comprises a speaker unit shell and a magnetic circuit system accommodated in the speaker unit shell, and the isolating mesh cloth is used for preventing the sound absorbing particles from entering the magnetic circuit system.

7. The speaker module according to claim 6, wherein the speaker unit further comprises a vibration system accommodated in the speaker unit shell, and the vibration system comprises a vibration diaphragm and a voice coil attached to one side of the vibration diaphragm, and the voice coil is suspended in the magnetic circuit system.

8. The speaker module according to claim 7, further comprising an electrical connection board, one end of the electrical connection board is electrically connected to the voice coil, and the other end of the electrical connection board is electrically connected to an external circuit of the speaker module.

* * * * *